US005259332A

United States Patent [19]

Sekiguchi et al.

[11] Patent Number: 5,259,332

[45] Date of Patent: Nov. 9, 1993

[54] METHOD FOR FORMING MODULES AND METHOD FOR ARRANGEMENT THEREOF

[75] Inventors: Kenji Sekiguchi; Yoshinori Imashimizu; Yoshiaki Suda; Shuichi Yamamoto, all of Kure; Toshiyuki Takada; Tadao Yokumoto, both of Hiroshima; Yoshihisa Nishimoto, Kure; Sadayuki Morita, Hyogo; Shinji Miura, Chita; Masanori Fukuoka; Osamu Yoshida, both of Tokyo; Kunihito Morioka; Tomohira Michishita, both of Kure, all of Japan

[73] Assignee: Ishikawajima-Harima Jukogyo Kabushiki Kaisha, Tokyo, Japan

[21] Appl. No.: 946,109

[22] Filed: Sep. 17, 1992

Related U.S. Application Data

[63] Continuation-in-part of Ser. No. 729,149, Jul. 12, 1991, abandoned.

[30] Foreign Application Priority Data

| | | | |
|---|---|---|---|
| Aug. 6, 1990 | [JP] | Japan | 2-206906 |
| Oct. 26, 1990 | [JP] | Japan | 2-289676 |
| Oct. 26, 1990 | [JP] | Japan | 2-289677 |

[51] Int. Cl.[5] ..... B63B 3/00

[52] U.S. Cl. ..... 114/65 R; 114/71

[58] Field of Search ..... 114/65 R, 71, 77 R, 114/356; 440/11

[56] References Cited

U.S. PATENT DOCUMENTS

| | | | |
|---|---|---|---|
| 3,363,597 | 1/1968 | Zeien | 114/65 |
| 3,875,887 | 4/1975 | Futtrup et al. | 114/65 R |
| 4,003,326 | 1/1977 | Horii et al. | 114/65 R |
| 4,678,439 | 7/1987 | Schlichthorst | 440/11 |

FOREIGN PATENT DOCUMENTS 1483757 6/1967 France .

OTHER PUBLICATIONS

Naval Engineers Journal, vol. 83, No. 5, Oct. 1971, Washington pp. 45-52; Spero, Hicks & Greene: 'A Philosophy of Naval Ship Design and Construction'.

*Primary Examiner*—David M. Mitchell
*Assistant Examiner*—Stephen P. Avila
*Attorney, Agent, or Firm*—Oblon, Spivak, McClelland, Maier & Neustadt

[57] ABSTRACT

Equipments such as outfits or plant elements are divided according to their functions. Some or all of equipments with related functions are accommodated as a module into a frame so that a plurality of frame modules are formed. The frame module is arranged in a space or the frame modules are arranged in three-dimensionally in the space.

2 Claims, 7 Drawing Sheets

METHOD FOR FORMING MODULES AND METHOD FOR ARRANGEMENT THEREOF

This is a continuation-in-part application of Ser. No. 07/729,149, filed Jul. 12, 1991, now abandoned.

BACKGROUND OF THE INVENTION present invention relates to an improved method of mounting equipment, other than a main engine, in the engine room of a ship.

Conventionally, an engine room in a ship is outfitted such that, as exemplarily shown in FIG. 9, various types of equipment c required for an engine room a are brought into the room and are arranged on a hull structure such as the deck b in the room. In the figure, reference character d exemplarily represents a piping arrangement; and e, a ventilation arrangement or an electric cable arrangement. The components c are not necessarily installed according to their particular functions but are usually arranged haphazardly in the engine room. As a result, for example, when operation or maintenance and inspection is to be performed for the lubricating and cooling system of a main engine, say, an operator or inspector must move to various sections of the engine room, resulting in inefficient operation or maintenance and inspection. Moreover, the components c are usually arranged two-dimensionally scattered over a relatively extensive range on the hull structure b of the engine room a, resulting in ineffective utilization of a space in the room.

The conventional method of installing engine room equipment on hull structure such as deck b can cause further problems. For example, there must be adjustment of detailed schedules in designing and outfitting steps for hull structure b and components c. Reinforcement members may be required for mounting the components on the hull structure b, and designing must be made with full consideration of the space available on the hull structure. Relocation of the components c is required upon any change in hull design since the layout for the engine room components depends upon hull structure.

An object of the present invention is therefore to facilitate operation and maintenance and inspection of various kinds of engine room equipment and to enable outfitting of an engine room independently of hull structure, thereby improving the design of an engine room and the supply and operation of engine room components as well as effectively utilizing the space in an engine room.

BRIEF SUMMARY OF THE INVENTION

In accordance with the present invention, engine room equipment, other than the main engine, is divided into groups according to the function of the equipment in each group and all or some of the equipments having functions related in common to respective engine room apparatus, e.g. steam generation equipment, main engine, etc. are accommodated in a frame, each frame defining a module. The frame modules can then be arranged in a space in a ship's engine room. A single frame module may be arranged in the space or a plurality of frame modules may be arranged three-dimensionally in the space, that is in abutting horizontally side-by-side and/or in vertically stacked relationship.

The frame modules with the accommodated components may be sized to be placed between or in place of hull structure block modules or may be placed in the hull structure block modules.

As described above, in accordance with the present invention, equipment can thus be modularized. A single module or plural modules may be replaceably arranged in a space three-dimensionally, thereby facilitating maintenance and inspection of equipment improving the designing of an engine room, supplying and operating the equipment and effectively utilizing available space.

Preferred embodiments of the present invention will be described in conjunction with drawings.

DETAILED DESCRIPTION OF THE PREFERRED EMBODIMENTS

Figure 1:
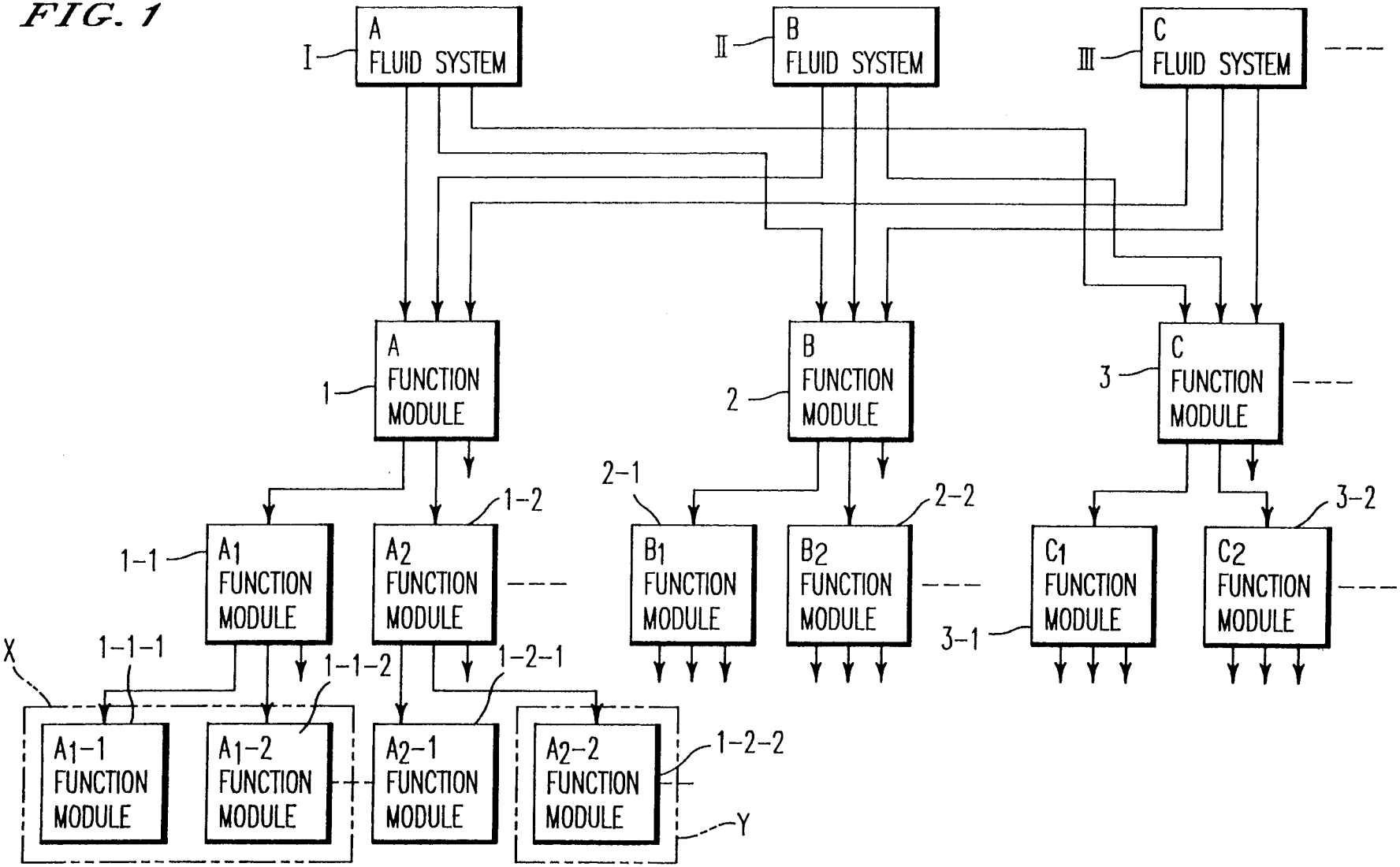
FIG. 1 shows an embodiment of a method for forming modules in accordance with the present invention and is a flow chart showing a procedure of dividing components into groups according to their functions.
Figure 2:
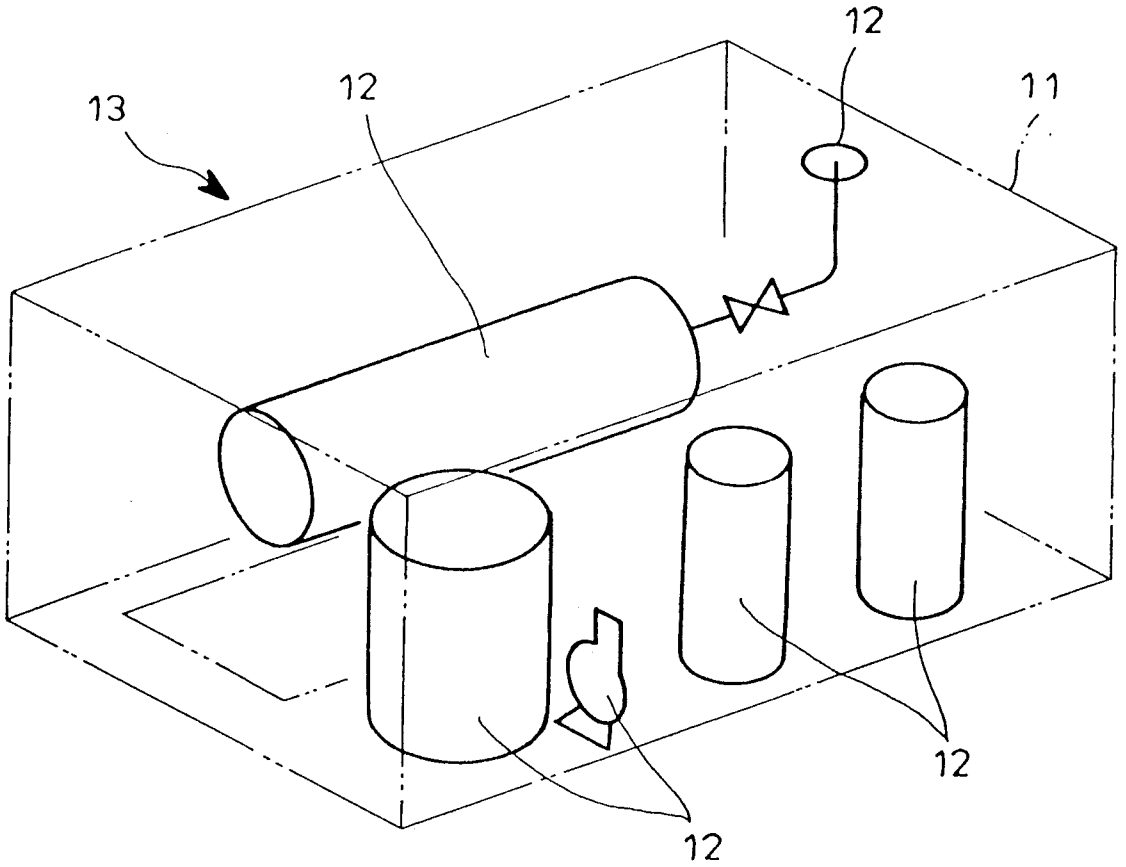
FIG. 2 is a perspective view of a frame module accommodating components grouped according to their functions by the procedure shown in FIG. 1.

FIGS. 1 and 2 represent an embodiment of the method for forming modules according to the present invention.

The "module" as described hereinafter is defined as a standard unit for facilitation of operation, maintenance and inspection, designing and outfitting and for minimization of dead space.

FIG. 1 is a flow chart showing a procedure of dividing fluid systems, for example, into group modules according to their functions where Roman numerals indicate the conventional classification according to fluid systems. I represents a fluid system (e.g., cooling fresh water system); II, b fluid system (e.g., lubricant system); and III, c fluid system (e.g., cooling seawater system). There are many other fluid systems although not shown in the figure.

Each of the fluid systems I, II, III, . . . include components having different functions. The equipments in each of the fluid systems I, II, III, . . . are divided or classified into groups according to their functions as A, B, C, . . . . Thus, components having a common function are grouped from the fluid systems I, II, III, . . . into A function module 1 (e.g., main engine lubricating and cooling module), B function module 2 (e.g., stern tube lubricating module), C function module 3 (e.g., steam generation module) . . . .

The components are divided into A, B, C, . . . function modules 1, 2, 3, . . . and components with related functions are accommodated in a standard frame of a certain volume, say, about the size of a 20 ft by 40 ft container. Thus, a frame module is made up. If the equipments can be accommodated in a standard frame only by dividing them into A, B, C, . . . function modules 1, 2, 3, . . . , there is no need of subdividing A, B, C, . . . function modules 1, 2, 3, . . . whereas, in the case of ship outfits, they can be hardly accommodated into the standard frames even when they are divided into main engine lubricating and cooling module, stern tube lubricating module and steam generation module.

For this reason, for each of the function modules 1, 2, 3, . . . , the modules may be further fractionized as to function. A function module may be subdivided into $A_1$ function module (e.g., cooling fresh water system) 1-1, $A_2$ function module (e.g., cylinder oil system) 1-2 . . . . Similarly, B function module 2 may be subdivided into $B_1$ function module 2-1, $B_2$ function module 2-2, C function module 3, into $C_1$ function module 3-1, $C_2$ function module 3-2, . . . ; . . . .

If necessary, $A_1$, $A_2$, . . . function modules 1-1, 1-2, . . . $B_1$, $B_2$, . . . function module 2-1, 2-2, . . . , $C_1$, $C_2$, . . . function modules 3-1, 32, . . . may be further fractionized. For example, $A_1$ function module 1-1 may be subdivided into $A_1$-1 function module (e.g., tank module) 1-1-1, $A_1$-2 function module (e.g., pump module) 1-1-2; $A_2$ function module 1-2, into $A_2$-1 function module 1-2-1 and $A_2$-2 function module 1-2-2-, . . . .

The equipment of each function module as described above are accommodated in the standard frame of for example 20 ft by 40 ft. Combination of modules differs according to the volumes of $A_1$-1 function module 1-1-1, $A_1$-2 function module 1-1-2, $A_2$-1 function module 1-2-1, $A_2$-2 function module 1-2-2 . . . . For example, as shown by two-dot chain line X in FIG. 1, $A_1$-1 and $A_1$-2 function modules 1-1-1 and 1-1-2 may be accommodated as a module into a frame to form a frame module, and as shown by two-dot chain line Y in FIGS. 1, $A_2$-2 function module 1-2-2 may be accommodated in a frame to form a frame module.

FIG. 2 shows a frame module 13 in which the components 12 are classified according to their functions by the procedure of FIG. 1 are accommodated in a standard frame 11 such as a container. A plurality of frame modules 13 are prepared and are accommodated three-dimensionally in a space.

Figure 3:
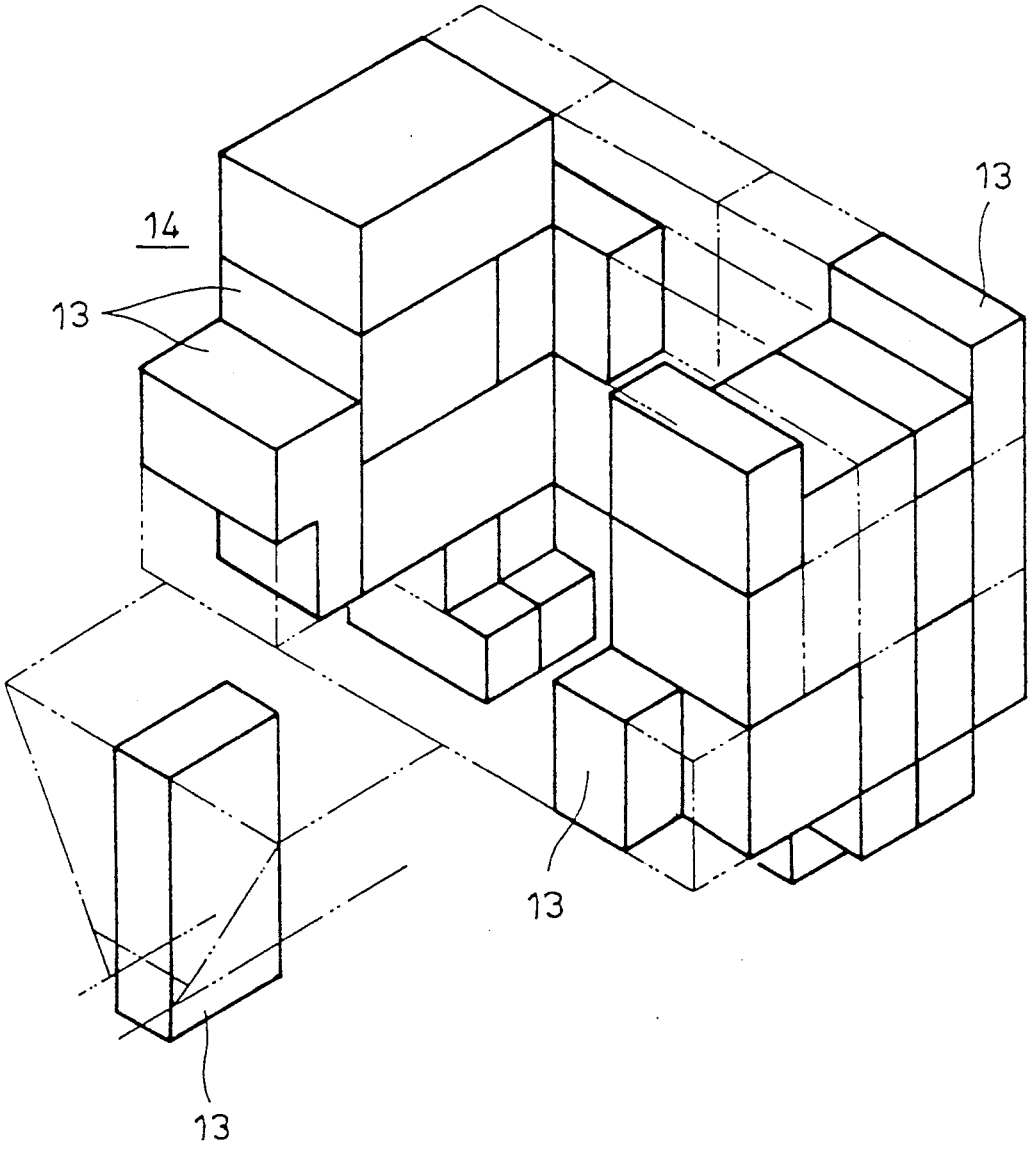
FIG. 3 shows a first embodiment of the method for arrangement of modules in accordance with the present invention and is a perspective view showing three-dimensional arrangement of the frame modules shown in FIG. 2.

FIG. 3 shows a first embodiment of the method for arrangement of modules in accordance with the present invention. In this embodiment, the frame modules 13 of FIG. 2 accommodate all equipment except the main engine and are three-dimensionally arranged in a space 14 such as an engine room as shown in the perspective view. Three-dimensional arrangement of the frame modules 13 is determined by giving full consideration as to function, operation and convenience in maintenance and inspection of the equipment. When performance or function characteristics of the equipments are to be changed, it is accomplished by replacing affected frame modules 13.

Figure 4:
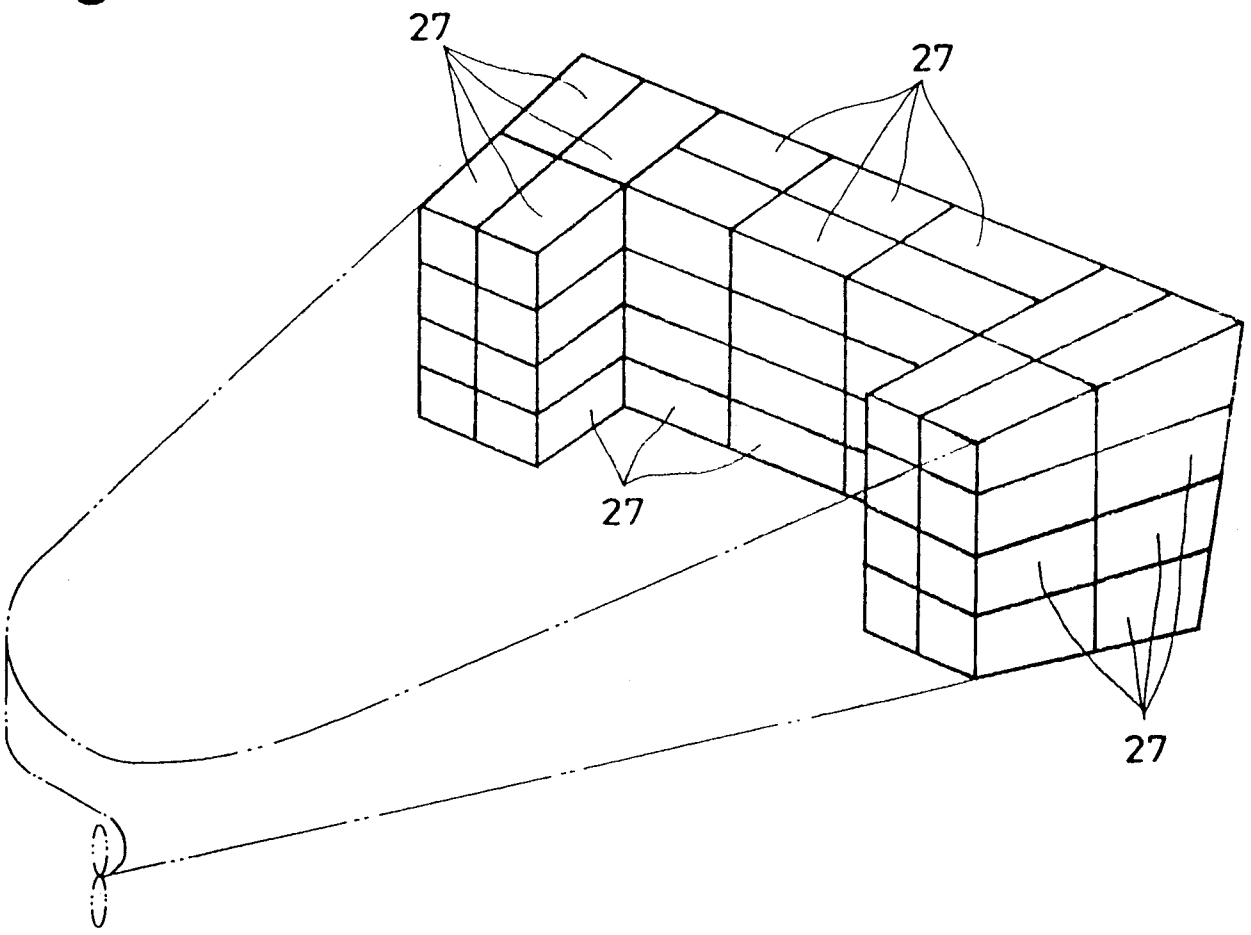
FIG. 4 is a perspective view of a second embodiment of the method for arrangement of modules in accordance with the present invention and shows three-dimensional arrangement of the frame modules in an engine room of a ship.
Figure 5:
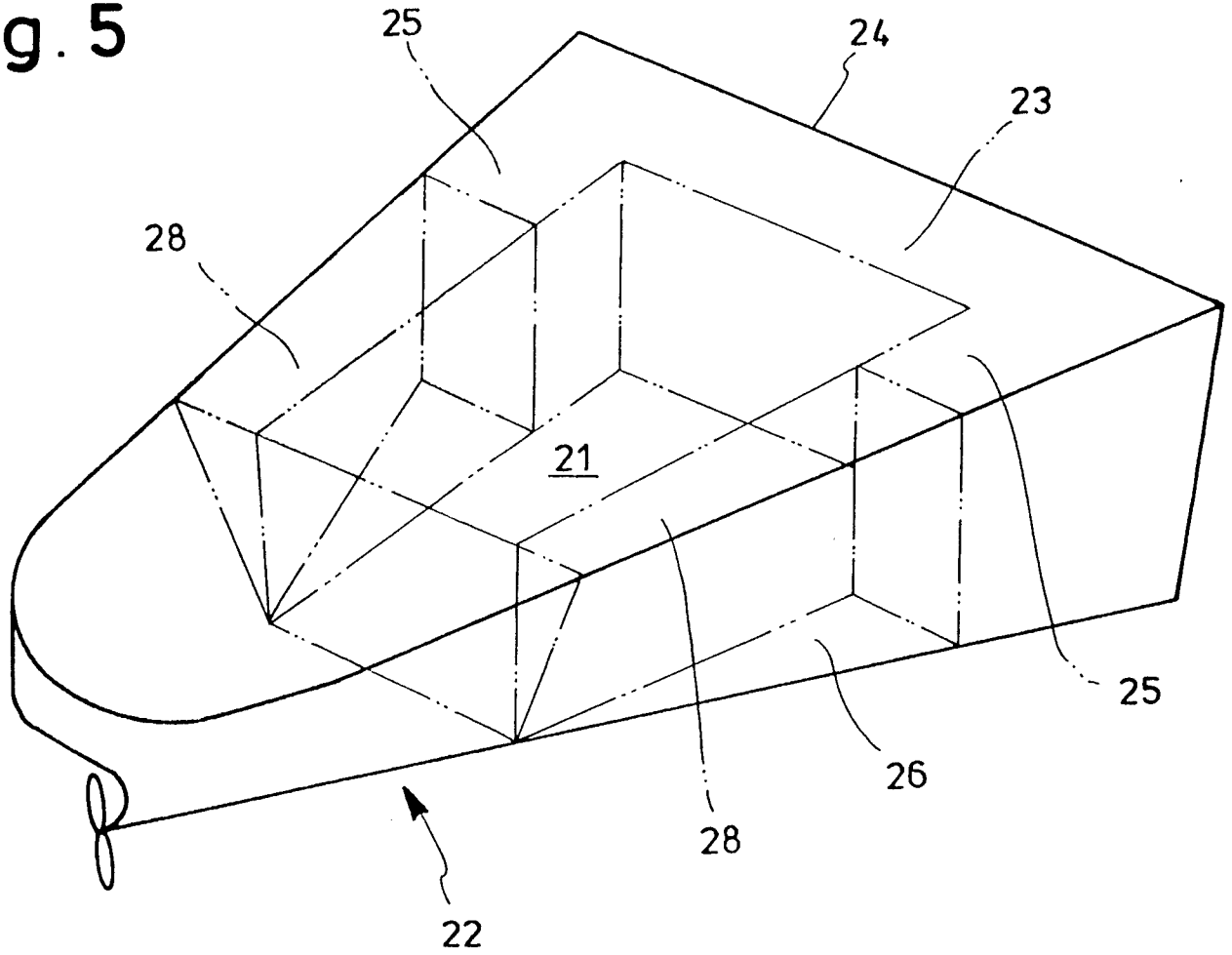
FIG. 5 is a perspective view showing spaces in an engine room of a ship shown in FIG. 4.

FIGS. 4 and 5 show a second embodiment of the method of arranging modules in accordance with the present invention.

In FIG. 5, reference numeral 21 represents an engine room of a ship 22; 23, a space aft of a transverse bulkhead 24 in the front portion of an engine room 21; and 25, spaces inside shell plates 26 near the bulkhead 24.

The frame modules arranged three-dimensionally in the above spaces 23 and 25 are formed similarly to the frame modules of FIG. 3 in the first embodiment. More specifically, components having the same functions are accommodated in a frame, with frame modules 27 are formed.

Three-dimensionally, for an arrangement as shown in FIG. 4, in the spaces 23 and 25 in the engine room 21 of FIG. 5. By three-dimensional arrangement of the frame modules 27 in vertical and horizontal directions, the components can be logically located regardless of the hull structure and the spaces 23 and 25 in the engine room 21 can be effectively utilized.

In the case of a small ship, the available spaces 23 and 25 are aft of transverse bulkhead 24 as seen in FIG. 5 while, in the case of a large ship, spaces 28 behind the spaces 25 can be utilized for three-dimensional arrangement of additional frame modules.

Figure 6:
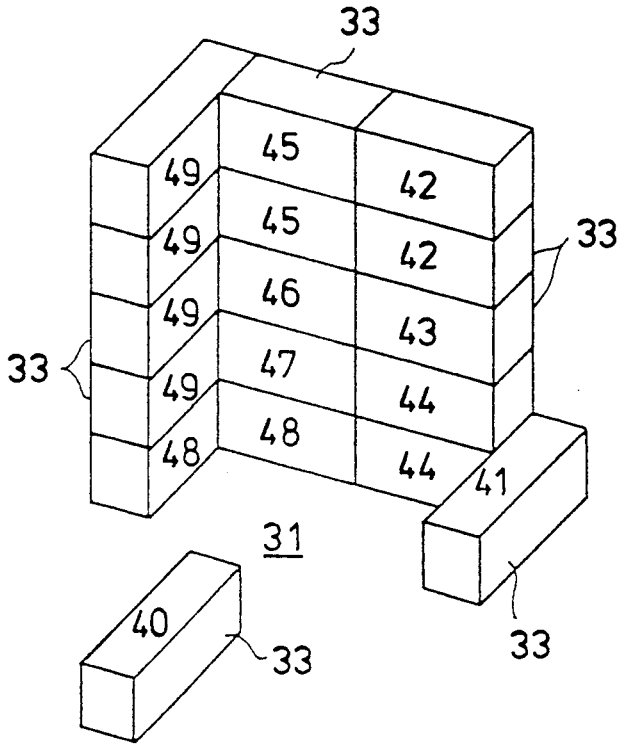
FIG. 6 is a perspective view of a third embodiment of the method for arrangement of modules in accordance with the present invention.
Figure 7:
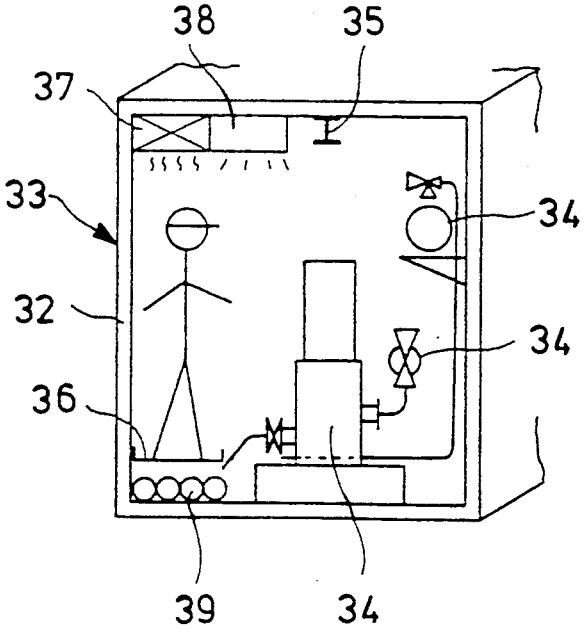
FIG. 7 shows an example of a frame module used in the method for arrangement of modules shown in FIG. 6.

FIGS. 6 and 7 represent a third embodiment of the method for arrangement of modules in accordance with the present invention.

As shown in FIGS. 6 and 7, components 34 necessary for the engine room 31 except the main engine are grouped according to their functions and are accommodated in frames 32, which may be of the size of standard containers and are unitized into frame modules 33. The frame module or modules 33 are then arranged as a single unit or as two or more units at one or more required points in the engine room 31 to complete outfitting in the engine room 31. Lifting means 35, passage means 36, ventilation means 37, lighting means 38, piping means 39, etc. are also accommodated in the frame 32, thus providing the frame module 33 with the grouped components 34. The frame modules 33 for the grouped components 34 are arranged in predetermined patterns 40 to 49 as in FIG. 6, thus completing the outfitting of the engine room 31. In FIG. 6, reference numeral 40 represents a propulsion section; 41, a bilge processing section; 42, an oil tank section; 43, an oil processing section; 44, a lubricant section; 45, a steam generation section; 46, a fresh water section; 47, an option space; 48, a seawater section; and 49, an elevator section. In the frame modules 33, therefore, the components 34 related to each of the outfit sections 40 to 49 are accommodated in a respective frame 32.

The use of frame modules 33 for components 34 of related functions necessary for the engine room 31, eliminates the work of installing the components on hull structure such as a single deck using reinforcement members as in the prior art and eliminate the necessity of adjusting the position of components in the available space of existing hull structure, thus facilitating the handling of components. Since outfitting can be performed independently of hull structure by use of the above frame modules 33, outfitting may be achieved at a place remote from a shipyard. Owing to modularization of the related components 34, design of equipment location may be achieved with the frame 32 being used as origin coordinates, thereby enhancing applicability to other ships.

Figure 8:
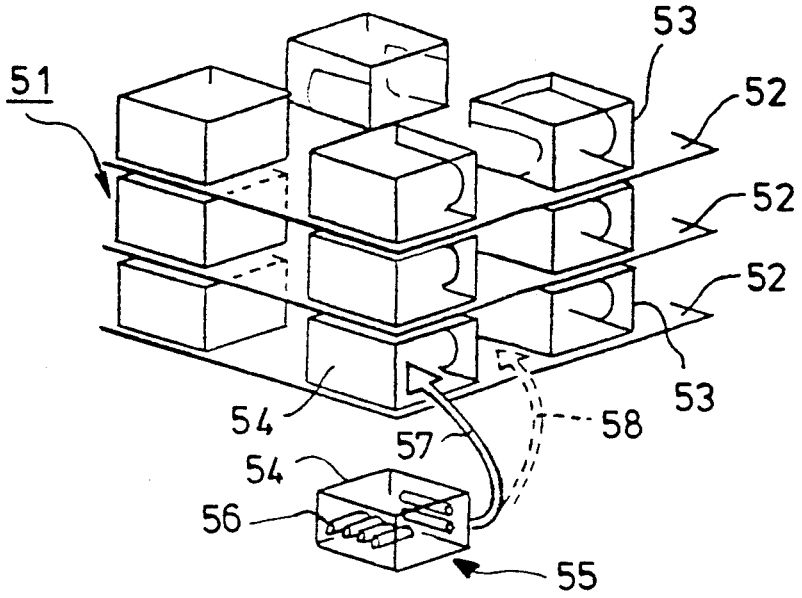
FIG. 8 is a perspective view of a fourth embodiment of the method for arrangement of modules in accordance with the present invention.
Figure 9:
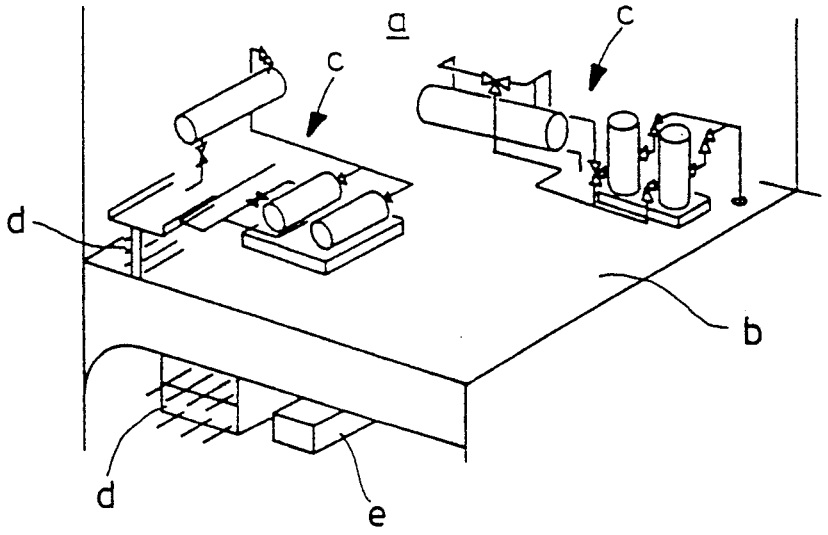
Fig. 9 PRIOR ART
FIG. 9 is a schematic illustration of an example of conventional arrangement of outfits in an engine room of a ship.

FIG. 8 shows a fourth embodiment of the method for arrangement of modules in accordance with the present invention.

In FIG. 8, reference numeral 51 represents a hull structure module which comprises deck modules 52 and block modules (skeleton structure modules) 53. Components 56 having related functions are accommodated in frames 54. The frames 54 with components therein define frame modules 55 which may be removably located in or between or in place of the hull structure block modules 53 as shown by the arrow 57 or 58.

In this way, the hull structure module 51 is subdivided into deck modules 52 and block modules 53 which are fabricated separately. The block modules 53 are designed to be seated on the deck modules 52 with at least some of the block modules being horizontally spaced from each other as shown. Replaceability of the hull structure block modules 53 will expand engineering range and enhance applicability to other ships. Subdivision of the hull structure module 51 in fabrication will shorten time period required for fabrication of the modules 51. Components 56 having related functions are accommodated in a frame 54 with a certain volume to make up a frame module 55 which is then removably placed in or between or in place of the hull structure block modules 53.

As described above, the method for forming modules in accordance with the present invention has meritorious effects of improving handling of equipment and facilitating maintenance and inspection.

1) The frame module means of the invention include engine room components except for a main engine, which will reduce vibration of the module means and lessen adverse effects due to such vibration.

2) The frame module means are arranged in horizontally side-by-side and vertically stacked relationships so that suspension of the frame module means from above, which would necessitate shock absorbers for absorbing rolling, is not required. That is, the claimed frame module means require no shock absorbers and therefore is simple in structure.

3) The frame module means are arranged on the basis of a predetermined pattern so that an optimum arrangement can be made depending upon shape of the engine room, thereby attaining optimum utilization of available space.

4) The frame module means are so arranged that there is no need of each module being respectively supported by the hull.

5) The frame module means may be arranged longitudinally, transversely and vertically with their ends being interconnected, which facilitates in saving of space.

6) Arrangement and combination of the frame module means may be freely planned in view of kind and size of a ship.

7) The frame module means which are designed for general use and which are arranged in a pattern can be used for various ships irrespective of kind and size of ship.

What is claimed as new and desired to be secured by Letters Patent of the United States is:

1. The method of mounting engine room equipment other than a main engine in the engine room of a ship comprising dividing said equipment into a plurality of groups, the equipment of each group having functions relating in common to respective engine room apparatus, mounting each group of equipment with related functions in a respective frame, each frame defining a module, and arranging said frame modules in abutting horizontally side-by-side and vertically stacked relationships in said engine room on the basis of a predetermined arrangement pattern.

2. A method of arrangement of modules which comprises subdividing a hull structure module into separately fabricated deck modules and block modules for seating on said deck modules with at least some of said block modules being horizontally spaced from each other, accommodating outfits having related functions in separate frames, each defining a frame module and being of a size placeable on a deck module in a block module or between block modules or in place of a block module, and replaceably placing said frame modules on said deck modules, in or between block modules or in place of said block modules.

* * * * *